US008561257B2

(12) United States Patent
Conrad

(10) Patent No.: US 8,561,257 B2
(45) Date of Patent: Oct. 22, 2013

(54) NOZZLE CONSTRUCTION FOR A CLEANING HEAD

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 669 days.

(21) Appl. No.: 12/720,371

(22) Filed: Mar. 9, 2010

(65) Prior Publication Data

US 2010/0229322 A1 Sep. 16, 2010

(30) Foreign Application Priority Data

Mar. 11, 2009 (CA) ..... 2658008

(51) Int. Cl.
*A47L 5/24* (2006.01)
*A47L 9/02* (2006.01)

(52) U.S. Cl.
USPC ..... 15/344; 15/422.1

(58) Field of Classification Search
USPC ..... 15/344, 422.1, 352–353, 347, 327.2, 15/348
See application file for complete search history.

(56) References Cited

U.S. PATENT DOCUMENTS

| | | | | |
|---|---|---|---|---|
| 6,122,796 | A | 9/2000 | Downham et al. | |
| 7,370,387 | B2 | 5/2008 | Walker et al. | |
| 2003/0106180 | A1 * | 6/2003 | Tsen | 15/321 |
| 2008/0040883 | A1 | 2/2008 | Beskow et al. | |

FOREIGN PATENT DOCUMENTS

| | | | |
|---|---|---|---|
| WO | 2008/009890 | A1 | 1/2008 |
| WO | 2008009883 | A1 | 1/2008 |
| WO | 2008009888 | A1 | 1/2008 |

OTHER PUBLICATIONS

Office Action, received in connection to U.S. Appl. No. 12/720,901, dated Jun. 10, 2011.

* cited by examiner

*Primary Examiner* — Robyn Doan
*Assistant Examiner* — Brianne Kalach
(74) *Attorney, Agent, or Firm* — Philip C. Mendes da Costa; Bereskin & Parr LLP S.E.N.C.R.L., s.r.l.

(57) ABSTRACT

A surface cleaning head for a vacuum cleaner comprises an open sided air flow passage upstream of an n enclosed air flow passage extending from an opening in the surface cleaning head to an air outlet. The open sided airflow chamber comprising an upper wall and a rear depending wall extending downwardly from the upper wall. The rear depending wall has a lower end that is positioned above the lower end of wheels. The opening is provided in a rear half of the upper wall of the air flow chamber forwardly of the rear depending wall and inwardly of the sides.

19 Claims, 8 Drawing Sheets

NOZZLE CONSTRUCTION FOR A CLEANING HEAD

FIELD

The specification relates to a cleaning head for a surface cleaning apparatus. In a preferred embodiment, the specification relates to a cleaning head for a hand vacuum cleaner.

INTRODUCTION

The following is riot an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims.

According to one broad aspect, a cleaning head is disclosed that produces good surface cleaning, is easier to clean and has a simplified structure. In accordance with this aspect, a surface cleaning head is provided with an airflow chamber that has an open lower side. When the nozzle is placed on a surface to be cleaned such as a floor, the floor defines a lower side of the airflow chamber. Air travels through the chamber to an inlet to an enclosed passage of the surface cleaning head. The enclosed airflow conduit may be of any configuration known in the surface cleaning arts. Accordingly, the air will travel some distance through the open sided airflow chamber prior to entering an enclosed conduit.

The airflow chamber has an upper wall and preferably extends under a portion of the cleaning head, preferably under a portion of an air treatment unit, which preferably comprises a cyclone, prior to entering the enclosed conduit. The inlet to the enclosed conduit preferably comprises an opening in the upper surface of the airflow chamber.

One or more wall extends downwardly from the upper wall of the airflow chamber and accordingly partially encloses at least one side of the airflow chamber. Preferably the airflow chamber is enclosed on three sides. A dirty air inlet to the airflow chamber is produced by an absence of a wall extending downwardly from the perimeter of the upper wall. For example, if the depending wall is provided on three sides of the upper wall, then the dirty air inlet may be defined by at least one opening or gap provided in this depending wall.

The depending wall is preferably spaced from the surface being cleaned. According to such an embodiment, the lower end of the airflow chamber is not sealed by the surface being cleaned. This permits a secondary dirty air inlet to be formed between the bottom of the depending wall and the surface being cleaned. This assists in reducing the likelihood that the airflow chamber may be clogged by the surface being cleaned and in reducing the push force required to move the surface cleaning head as otherwise a high vacuum may be created in the airflow chamber.

The surface cleaning head may include at least one air treatment unit. For example, the cleaning head is preferably used with a hand vacuum cleaner. The air treatment unit preferably comprises at least one cyclone.

If the surface cleaning head includes at least one air treatment unit, then the open sided airflow chamber or nozzle and a portion of the air treatment unit, e.g., a dirt collection chamber, may be integrally molded together or separately manufactured and then assembled together as a one-piece assembly. In either embodiment, the nozzle and the dirt collection chamber may then be removed concurrently (e.g., in a single operation) from, e.g., a surface cleaning apparatus. Once removed, the dirt collection chamber may be emptied. During operation, dirt may build up in the open sided airflow chamber and/or the dirt collection chamber. These components once separated from, e.g., a hand vacuum cleaner, may be cleaned by, for example, washing them in water.

In a preferred embodiment, the air treatment unit includes a dirt collection chamber, such a dirt collection chamber for a cyclone. The dirt collection chamber is preferably removable in a sealed configuration. For example, a cyclone unit may comprise a cyclone and a dirt collection chamber assembly. The assembly may be removably mounted to a hand vacuum cleaner. Accordingly, the dirt collection chamber may be closed (e.g., have a closed lid) when removed from the hand vacuum cleaner.

A further advantage of this design is that the hand vacuum cleaner may have a simplified structure. By providing the nozzle as part of the dirt collection chamber, and preferably as part of a cyclone unit, such an assembly may be removably mounted to a motor housing. Accordingly, a skeleton or backbone to which individual components are mounted is not required and is preferably not used. Such a design may be lighter, permitting a user to use a hand vacuum cleaner for a longer continuous period of time.

Accordingly, for example, a surface cleaning head for a vacuum cleaner is provided which comprises a front end, a rear end, and sides extending between the front end and the rear end. An enclosed airflow passage extends from an opening to an air outlet. A plurality of wheels is provided which have a lower end. The surface cleaning head further comprises an airflow chamber. The airflow chamber comprises an upper wall, and a rear depending wall extending downwardly from the upper wall. The rear depending wall has a lower end that is positioned above the lower end of the wheels. The upper wall and the rear depending wall define an airflow chamber having an open lower end. The opening is provided in a rear half of the upper wall of the air flow chamber forwardly of the rear depending wall and inwardly of the sides.

In some examples, the surface cleaning head further comprises side depending walls. The rear depending wall and the side depending walls may form a generally U-shaped wall. Further, the side depending walls may have a lower end that is spaced above the lower end of the wheels and accordingly spaced above a hard surface on which the cleaning head is placed. The lower end of the depending walls may be spaced from 0.01 to 0.175 inches above the lower end of the wheels (e.g., the gap between the lower end of the depending walls and a floor), and more preferably, spaced from 0.04 to 0.075 inches above the lower end of the wheels.

In some examples, the opening is in the upper wall. The opening may face a surface to be cleaned when the surface cleaning head is positioned on the surface to be cleaned. The opening may be in communication with a passage that extends generally vertically upwardly.

In some examples, the airflow chamber has an absence of agitation members and air jet members.

In some examples, the airflow chamber extends to the front end of the surface cleaning head and a dirty air inlet is positioned at the front end of the surface cleaning head.

In some examples, the surface cleaning head has a longitudinal axis and a transverse width, the opening is spaced transversely inwardly from the side walls by a distance, the opening has a transverse width, and the distance is from 1 to 5, preferably 2 to 3 times the transverse width. Further, the opening may have a longitudinal length and may be positioned rearwardly from the front end by at least a distance equal to the longitudinal length.

In some examples, the cleaning head is part of a hand vacuum cleaner.

It will be appreciated that a surface cleaning head may incorporate one or more of the features of each of these examples.

DRAWINGS

In the detailed description, reference will be made to the following drawings, in which.

DESCRIPTION OF VARIOUS EXAMPLES

Figure 1:
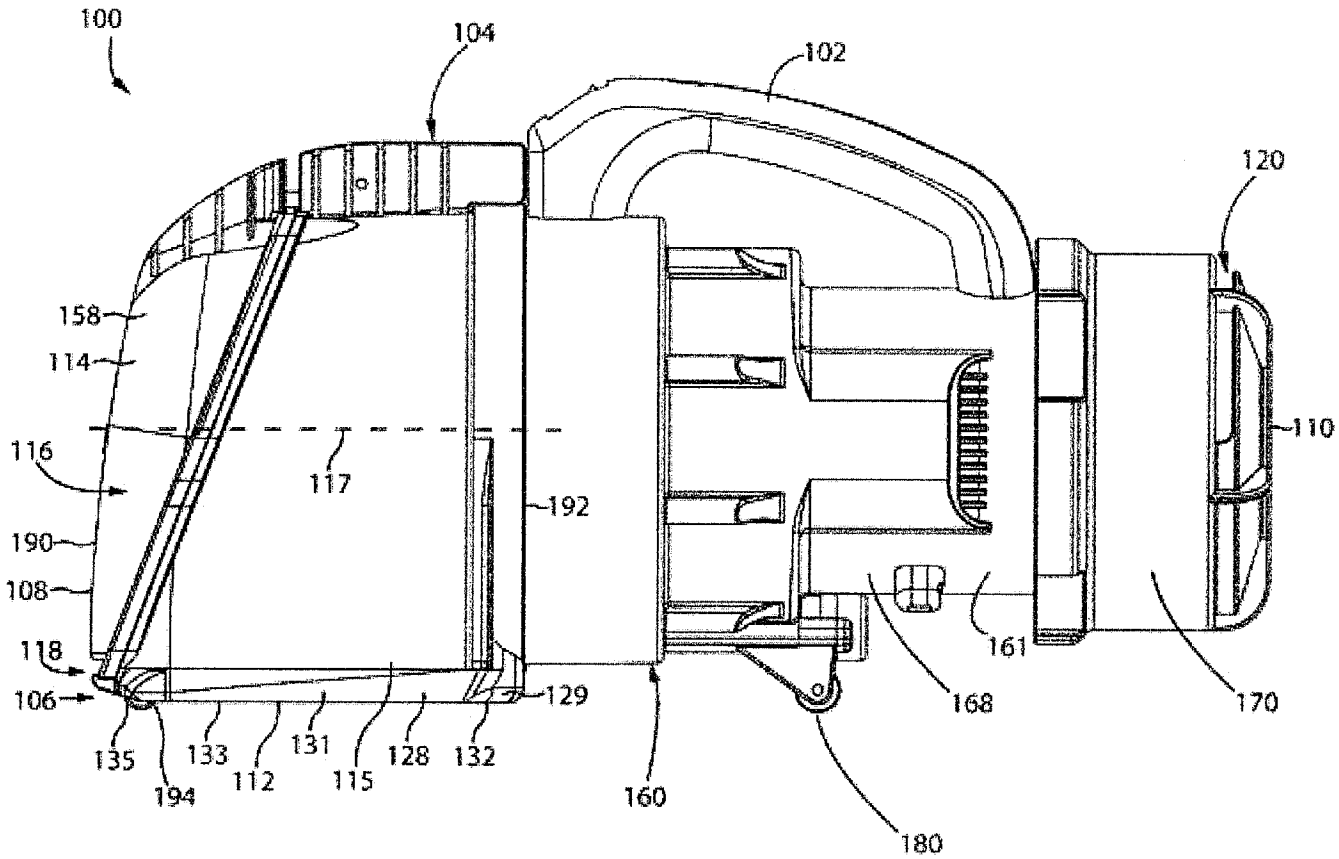
FIG. 1 is a side plan view of an example of a hand vacuum cleaner.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

The surface cleaning head may be of various configurations and may incorporate operating units of a surface cleaning apparatus, such as a suction motor. In a particularly preferred embodiment, the surface cleaning head may be incorporated into a hand vacuum cleaner. However, it may also be used in a cleaning head for other domestic vacuum cleaner designs.

In the drawings attached hereto, the surface cleaning head is exemplified as used in a hand vacuum cleaner that uses a cyclone. It will be appreciated that the vacuum cleaner 100 may be of various configurations (e.g., different positioning and orientation of the cyclone unit and the suction motor and differing cyclone units that may comprise one or more cyclones and one or more filters). Alternately, the design may be used in a hand vacuum cleaner that does not utilize cyclonic cleaning.

Referring to FIGS. 1 to 8, an example of a vacuum cleaner 100 incorporating the cleaning head is shown. The vacuum cleaner 100 is a hand vacuum cleaner, and is movable along a surface to be cleaned by gripping and maneuvering handle 102. The vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and an air treatment unit 114, which together form a surface cleaning head 116 of the vacuum cleaner 100. In the example shown, the surface cleaning head 116 is provided at the front 108 of the vacuum cleaner 100. The surface cleaning head 116 has a transverse width $W_h$, and a longitudinal axis 117. The cleaning head 116 includes an outer wall 115. The outer wall 115 includes a lower outer wall 119, which in the example shown is generally planar, and which faces a surface to be cleaned when the vacuum cleaner 100 is in use. It will be appreciated that in other embodiments, the cleaning head may not include an air treatment unit.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Air treatment unit 114 is provided in the airflow passage, downstream of the dirty air inlet 118. In the example shown, the air treatment unit 114 comprises one cyclone 122, and one dirt chamber 124. In alternate examples, the cyclone unit 110 may include more than one cyclonic stage, wherein each cyclonic stage comprising one or more cyclones and one or more dirt chambers. Accordingly, the cyclones may be arranged in parallel and/or in sequence. Alternate air treatment members, such as filters may be used instead of, or in addition to cyclone 122.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath at least a portion of the air treatment unit 114 and, more preferably, all of the nozzle is beneath the air treatment unit 114. Nozzle 112 may be integrally formed as part of a surface cleaning head. For example, nozzle 112 may be integrally formed with cyclone unit 114. However, it will be appreciated that nozzle 112 may be secured to a surface cleaning head by other means known in the vacuum cleaner arts.

Figure 6:
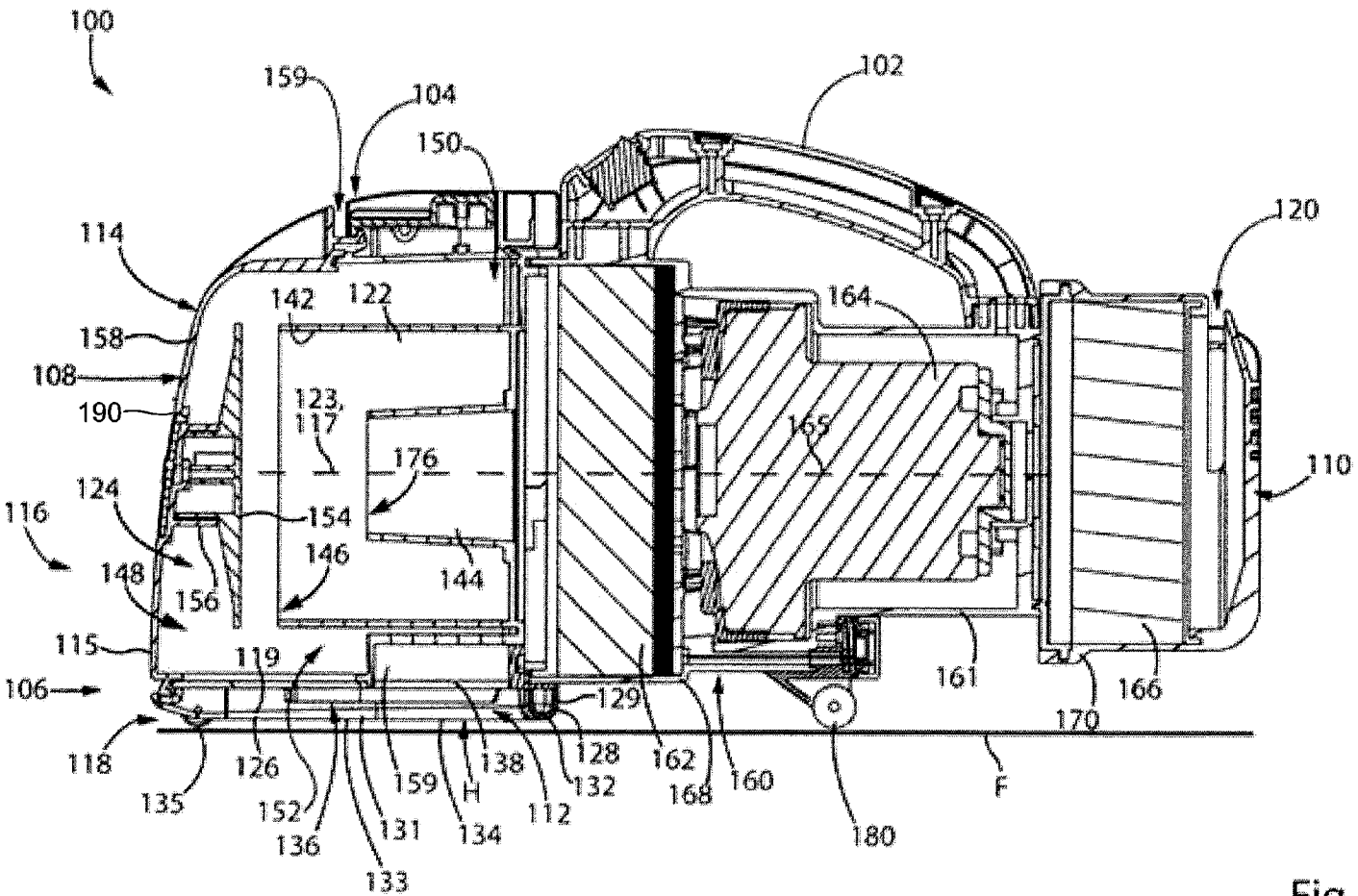
FIG. 6 is a cross section taken along line 6-6 in FIG. 2.

Nozzle 112 preferably shares a wall with a component of the cleaning head and preferably with a component of air treatment unit 114. Accordingly, as exemplified, nozzle 112 may be on lower surface 157 of cyclone unit 114. In a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
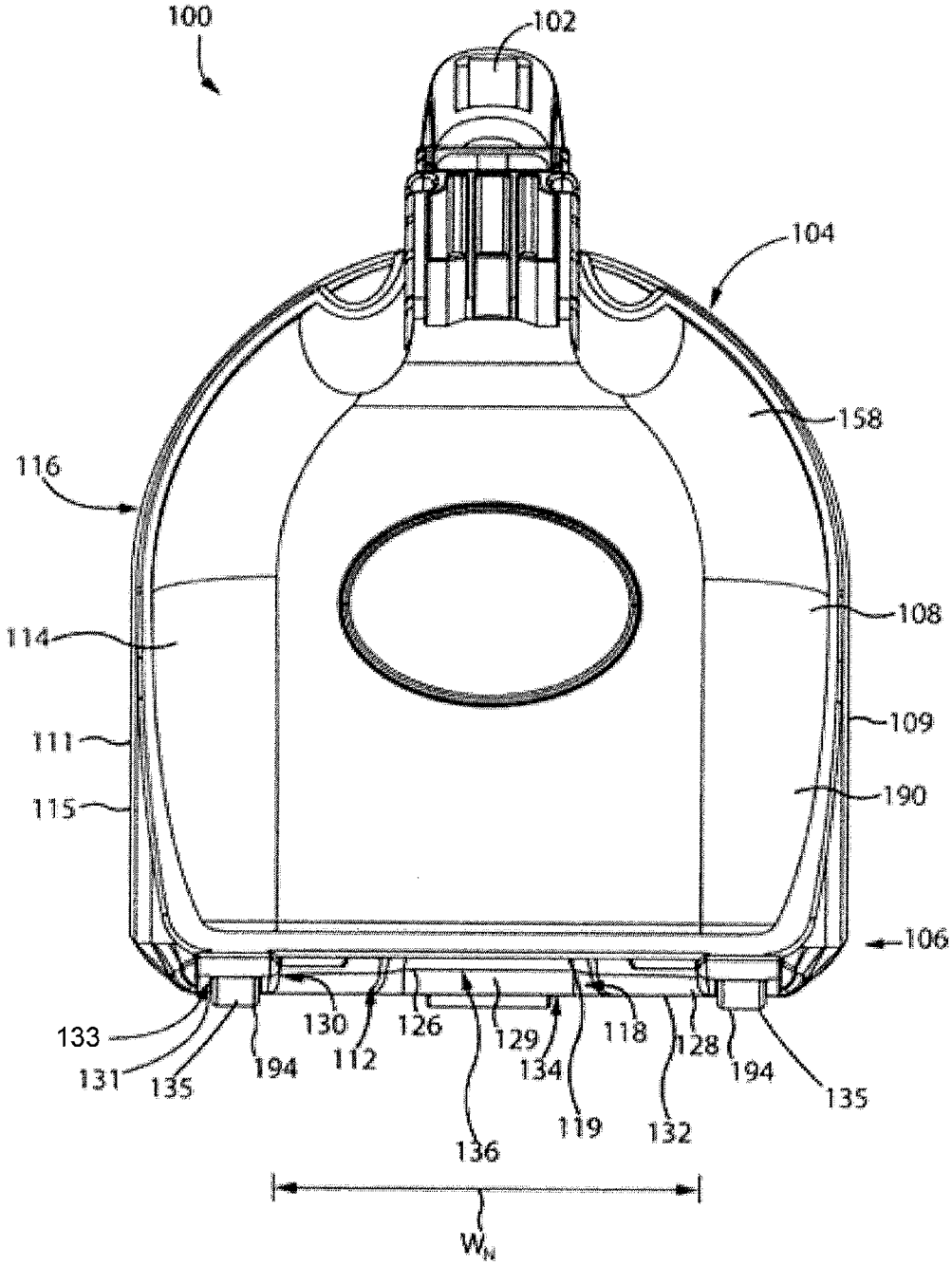
FIG. 3 is a front plan view of the hand vacuum cleaner of FIG. 1.
Figure 5:
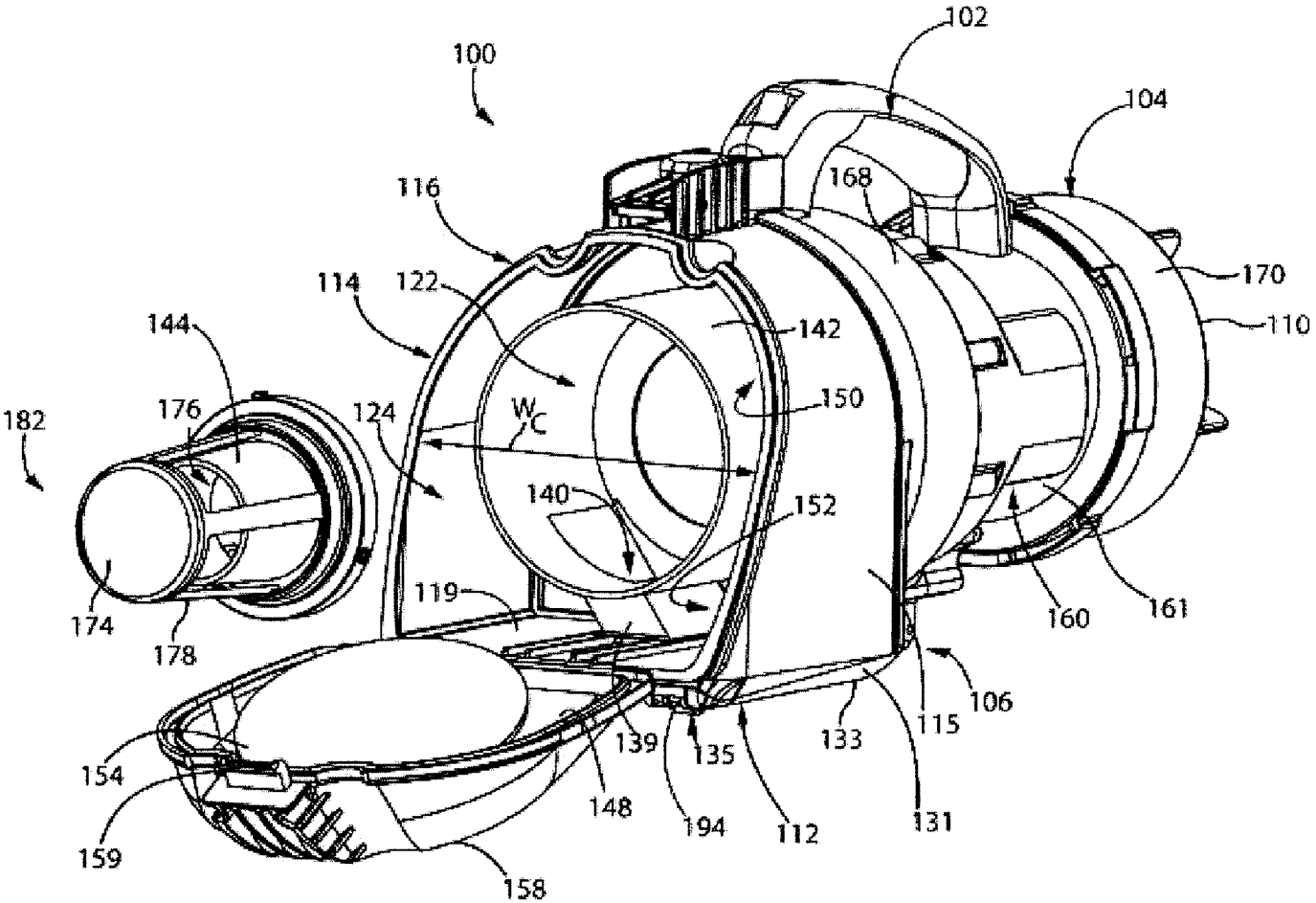
FIG. 5 is a partially exploded front perspective view of the hand vacuum cleaner of FIG. 1.

As shown in FIGS. 3 and 5, nozzle 112 has a width $W_N$, and air treatment unit 114 has a width $W_C$. In the example shown, $W_N$, and $W_C$ are about the same. An advantage of this design is that the nozzle may have a cleaning path that is essentially as wide as the hand vacuum itself.

Figure 7:
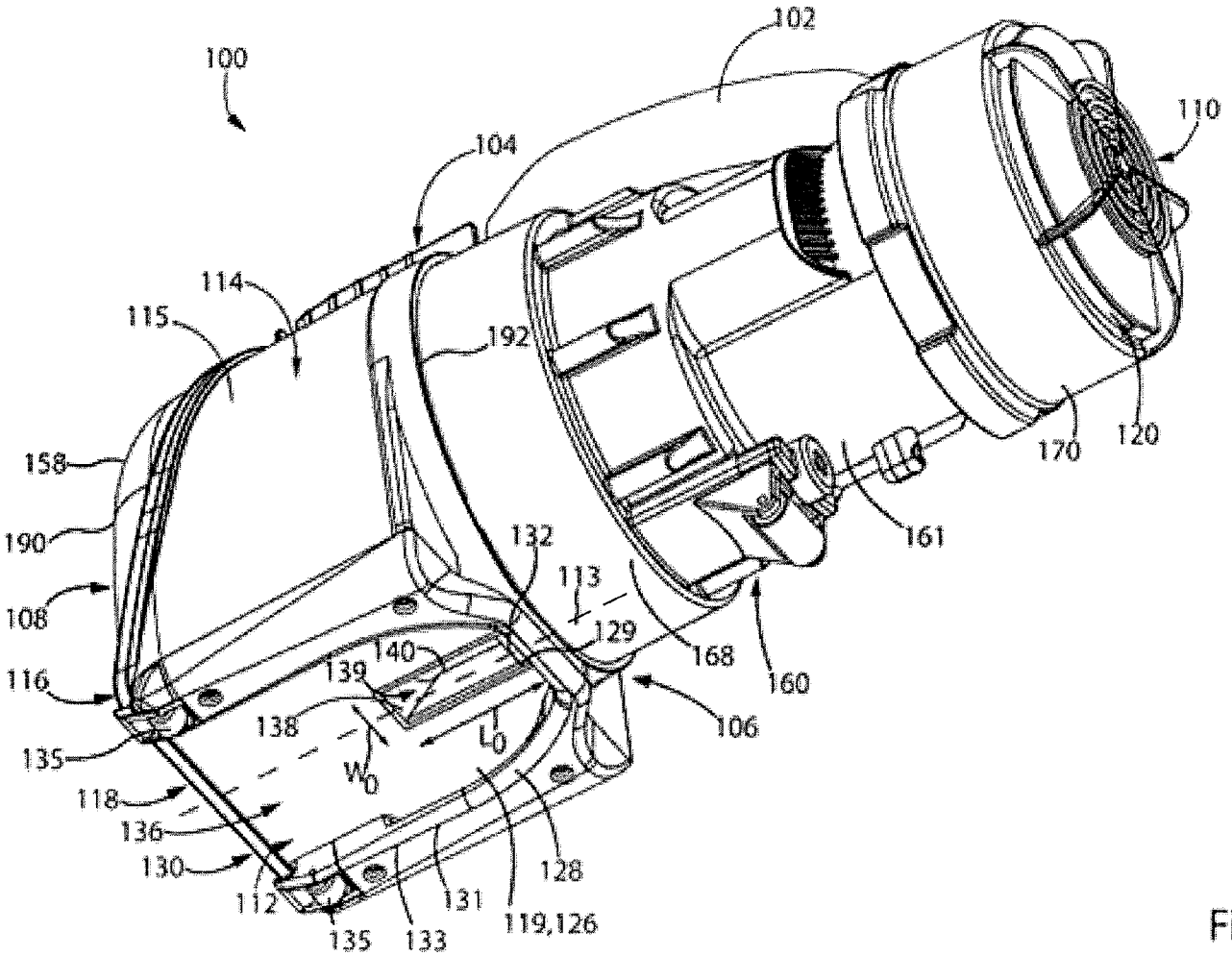
FIG. 7 is a bottom perspective view of the hand vacuum cleaner of FIG. 1.
Figure 8:
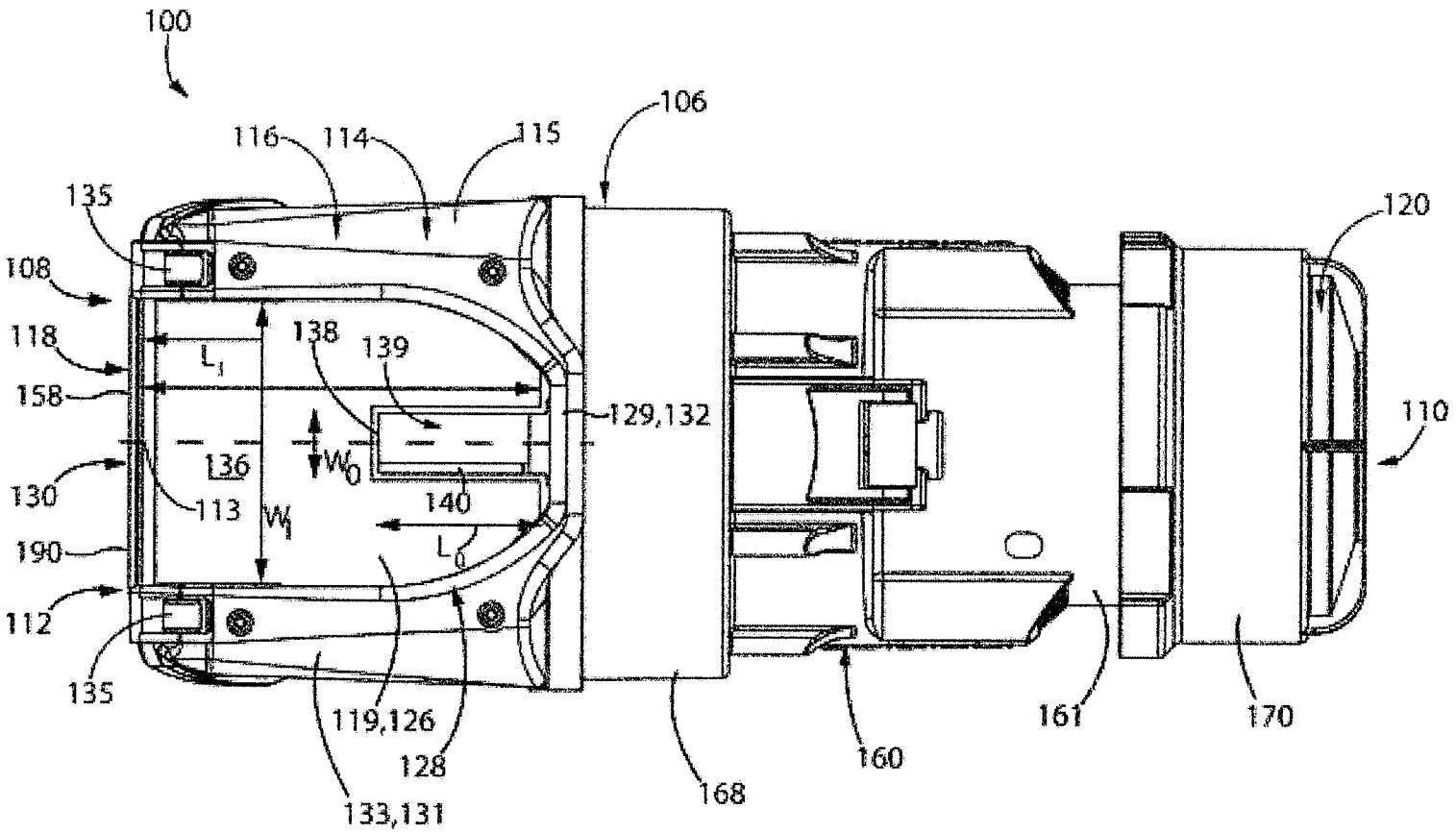
FIG. 8 is a bottom plan view of the hand vacuum cleaner of FIG. 1.

Referring now to FIG. 7, nozzle 112 comprises an airflow chamber, wherein at least a portion, and preferably a majority, of the lower surface of the chamber 136 is open. Nozzle 112 comprises an upper wall 126, which defines a closed upper end of the airflow chamber 136. In the example shown, the lower outer wall 119 of the surface cleaning head 116 forms the upper wall 126. Nozzle 112 further comprises a rear depending wall 129 extending downwardly from the upper wall 126. The rear depending wall 129 has a lower end 132. The rear depending wall 129 and the upper wall 126 define the airflow chamber. In the preferred example shown, the nozzle 112 further comprises two side depending walls 131, which have a lower end 133. In the preferred example shown, the rear 129 and side 131 depending walls are integral, and form a common depending wall 128. The common depending wall 128 is generally U-shaped. The open end of the U-shape defines an open side 130 of the airflow chamber 136, and forms the dirty air inlet 118 of the cleaner 100.

The depending walls 129, 131, may be continuous to define a common wall 128 as shown, or may be discontinuous. The depending walls are preferably rigid (e.g., integrally molded with cyclone unit 114). However, they may be flexible (e.g., bristles or rubber) or moveably mounted to cyclone unit 114 (e.g., hingedly mounted).

It will be appreciated that in alternate examples, side depending walls 131 may not be provided. Further, side depending walls 131 may extend part way along the length of the airflow chamber from the front of the surface cleaning head. Alternately, or in addition, the side depending walls 131 may have a rear end that is spaced from rear wall 129.

Figure 2:
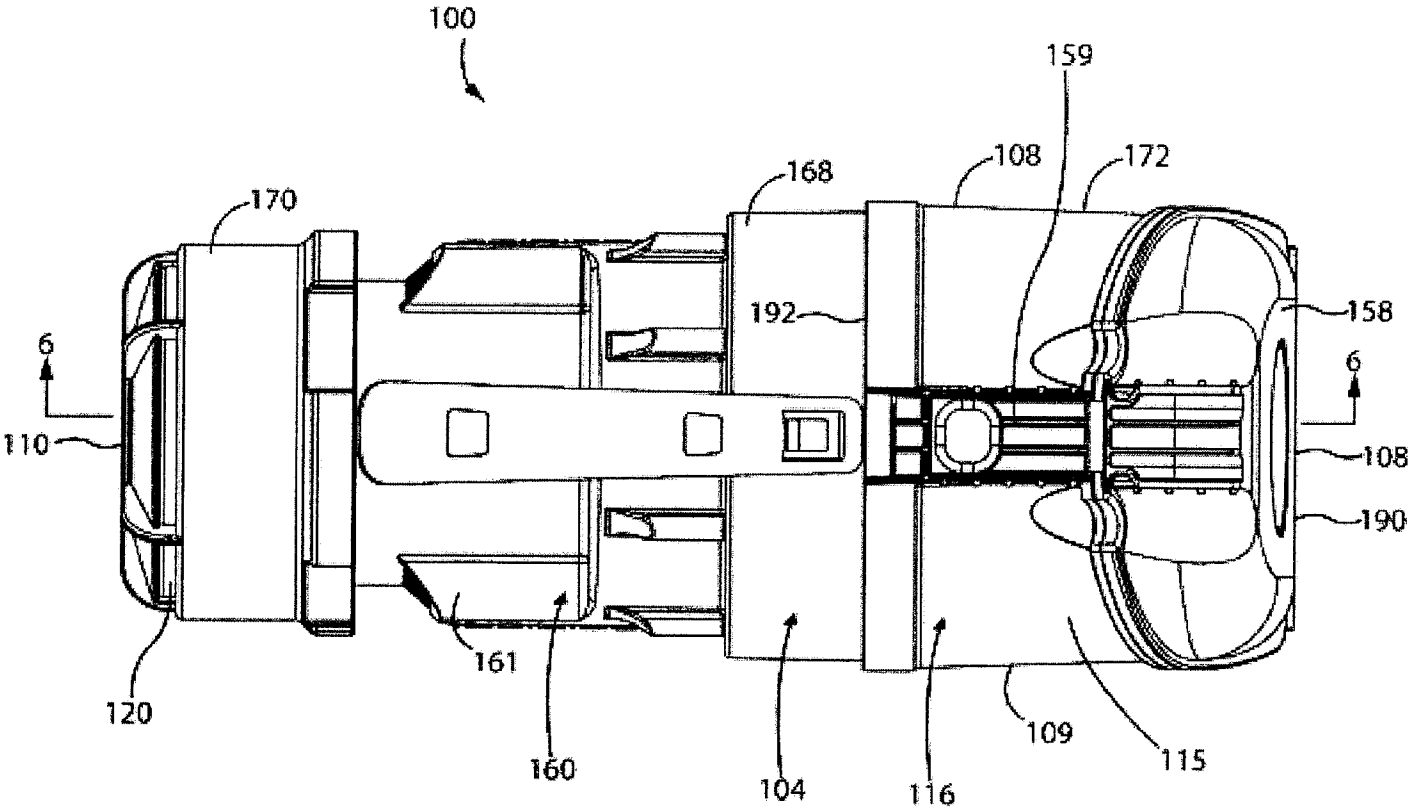
FIG. 2 is a top plan view of the hand vacuum cleaner of FIG. 1.

When viewed in plan view from above, as shown in FIG. 2, surface cleaning head 116 defines a perimeter 172, which includes a front end 190 at the front 108 of the hand vacuum cleaner 100, a rear end 192, and sides 109 and 111 extending therebetween. In the preferred example shown, the open side 130 is positioned at the perimeter, and more particularly, at the front end 190. Accordingly, airflow chamber 136 extends to the front end 190 of the surface cleaning head, and the dirty air inlet 118 is provided at the front end 190 of the surface cleaning head.

In the example shown, the lower end 132 of the depending wall 128 defines an open lower end 134 of the airflow chamber 136. The open lower end 134 extends to the front 108 of the cleaner 100, and merges with the open side 130. In use, the open lower end 134 faces a surface to be cleaned.

In the example shown, a plurality of wheels 135 are mounted to the depending wall 128. The lower end 194 of the wheels 135 preferably extends lower than the lower end 132 of the rear depending wall 129. That is, the lower end 132 of the rear depending wall 129 is preferably spaced above the lower end 194 of the wheels 135. Further, in the example shown, the lower end 194 of the wheels extends lower than the lower end 133 of the side depending walls 131. Accordingly, in use, when wheels 135 are in contact with a surface to be cleaned, such as a hard horizontal surface, the lower end 132 of the rear depending wall 129, and the lower ends 133 of the side depending walls 131 are spaced from and above the surface. For example, the lower ends 132, 133 of the depending walls 129, 131 may be spaced a distance H of from 0.01 to 0.175 inches above the lower end 194 of the wheels. More particularly, the lower ends 132, 133 of the depending walls 129, 131 may be spaced from 0.04 to 0.08 inches above the lower end 194 of the wheels, thereby defining a gap between the lower end of the depending wall or walls and a hard floor.

The height of the depending walls 129, 131 (between upper nozzle wall 126 and lower ends 132, 133) may vary. In some examples, the depending walls may have a height of between about 0.05 and about 0.875 inches preferably between about 0.125 and about 0.6 and more preferably between about 0.2 and about 0.4. The height of depending walls 129, 131 may vary but is preferably constant. The height of the wall is preferably based upon the cross sectional area required for the air flow. Accordingly, if the air flow rate is increased, a taller depending wall is preferred. The parameters provided herein are preferred for an air flow rate of about 50 cfm and a width of the nozzle transverse to the direction of air flow of about 6 inches.

Accordingly, in use, when wheels 135 are in contact with a surface (preferably a hard surface), the open side 130 preferably sits above and is adjacent a surface to be cleaned.

In the example shown, the airflow chamber 136 does not include any agitation members or air jet members (i.e., it has an absence of a agitating members and air jet members). However, in alternate examples, the airflow chamber 136 may include agitation members or air jet members.

In use, when wheels 135 are in contact with a horizontal surface, the nozzle 112 and the airflow chamber 136 preferably extend generally horizontally, along a chamber axis 113.

In the example shown, opening 138 is preferably provided in the upper wall 126 of nozzle 112 (i.e. in the lower outer wall 119), and is in communication with the airflow chamber 136. More particularly, airflow chamber 136 is upstream of opening 138. Opening 138 defines an inlet an enclosed passage through the surface cleaning head and, if the surface cleaning head includes an air treatment member, opening 138 may be the entrance to an inlet extending to the air treatment unit.

In the example shown, the portion of the airflow passage upstream of opening 138 is not enclosed, as lower end 134 of nozzle 112 is open. In contrast, the portion of the airflow passage upstream of opening 138 is enclosed. That is, the portion of the airflow passage between opening 138 and the outlet 145 of the air treatment unit 114 is enclosed, and the portion of the airflow passage between the outlet 145 of the air treatment unit and the clean air outlet 120 of the cleaner 100 is enclosed.

Opening 138 has a width $W_o$, and a length $L_o$ transverse to the width $W_o$. Width $W_o$, may be from 0.375 to 1.5, preferably from 0.5 to 0.875 and more preferably from 0.625 to 0.75 inches. Length $L_o$ may be from 0.5 to 3, preferably from 1 to 2.5 and more preferably from 1.25 to 2 inches.

Opening 138 is provided in a rear half of the upper wall 126, forwardly of rear depending wall 129, inwardly of sides 109 and 111, and above the airflow chamber 136. Accordingly, airflow chamber 136 extends from the dirty air inlet 118 rearwardly to the opening 138. Opening 138 may be positioned laterally inwardly from sides 109 and 111 by a distance that is from 1 to 5, preferably from 2 to 3 times the width $W_o$ of the opening 138.

The length of nozzle 112 from rear wall 129 to the front of the nozzle, $L_l$, may be up to 30 times $L_o$, preferably from 1.5 to 10 times $L_o$, and more preferably from 2 to 5 and most preferably about 2.5 to 4 times $L_o$. As exemplified, if side the depending walls are not straight, then the length of inlet 112 may vary.

The width of nozzle 112 from between side depending walls 128, $W_l$, may be up to 30 times $W_o$, preferably from 2 to 30 times $W_o$, and more preferably from 2 to 10 times $W_o$. As exemplified, if the side depending walls are not straight, then the width of inlet 112 may vary.

Opening 138 may be adjacent rear depending wall 129 but is preferably spaced therefrom by at least 0.125 inches, preferably at least 0.25 inches. Opening 138 may be spaced from rear depending wall 129 by a distance that is from 0 to 10 times $L_o$, preferably from 0.1 to 5 and more preferably from 0.25 to 1 times $L_o$.

In use, when wheels 135 are in contact with a surface, the opening 138 faces a surface to be cleaned, air preferably enters the dirty air inlet 118, travels from the open side wall 130, passes horizontally through the airflow chamber 136, under the cleaning head 116, into the opening 138 and enters the air treatment unit 114. If the air treatment unit incorporates a cyclone, then opening 138 is in communication with a cyclone inlet passage 139, which is in communication with a cyclone air inlet 140 of cyclone 122. The passage 139 preferably extends upwardly from opening 138, and the cyclone air inlet 140 is preferably positioned above opening 138. In the preferred example shown, cyclone air inlet 140 is fixed above the opening 138. That is, in use, when dirty air inlet 118 is adjacent a surface to be cleaned, cyclone air inlet 140 is above opening 138, and is not repositionable with respect to opening 138.

If air treatment unit 114 includes a cyclone 122, then cyclone 122 may of any configuration and orientation and any screen, shroud or filter known in the art may be provided at the cyclone air exit. Further, the cyclonic dirt collection chamber may be of any design and location. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and preferably extends generally horizontally when cleaner 100 is in use and wheels 135 are seated on a surface. The cyclone 122 has an air inlet 140 and an air outlet 145, which preferably are at the same end of cyclone 122. Preferably the air inlet and the air outlet are distal to front end 108. The cyclone air inlet and cyclone air outlet may be of any configuration known in the art and the cyclone air outlet may be covered by a screen or shroud or filter as is known in the art.

As exemplified. the cyclone air inlet 140 is defined by an aperture in the chamber wall 142. As can be seen in FIG. 5, the inlet passage 139 is at configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, which defines an outlet 145 of the surface cleaning head 116.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt chamber 124. The dirt chamber may be internal or external to the cyclone chamber. Preferably, as exemplified, the dirt chamber is external. The dirt chamber may be in communication with the cyclone chamber by any means known in the art. Accordingly, one or more dirt outlets may be provided. Preferably, the dirt outlet is at the end opposed to the air inlet and, preferably, the dirt outlet is at the front end 108.

In the example shown, dirt chamber 124 comprises two portions. A first portion 148 is provided immediately adjacent the dirt outlet 146, and is at the front 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt chamber 124, adjacent the dirt outlet 146. The separation plate 154 aids in preventing dirt in dirt chamber 124 from re-entering cyclone 122. Preferably, plate 154 is spaced from dirt outlet 146 and faces dirt outlet 146. Plate 154 may be mounted by any means to any component in cyclone unit 114. As exemplified, the separation plate is mounted on an arm 156, which extends from a front wall 158 at the front 108 of the cleaner 100.

Figure 4:
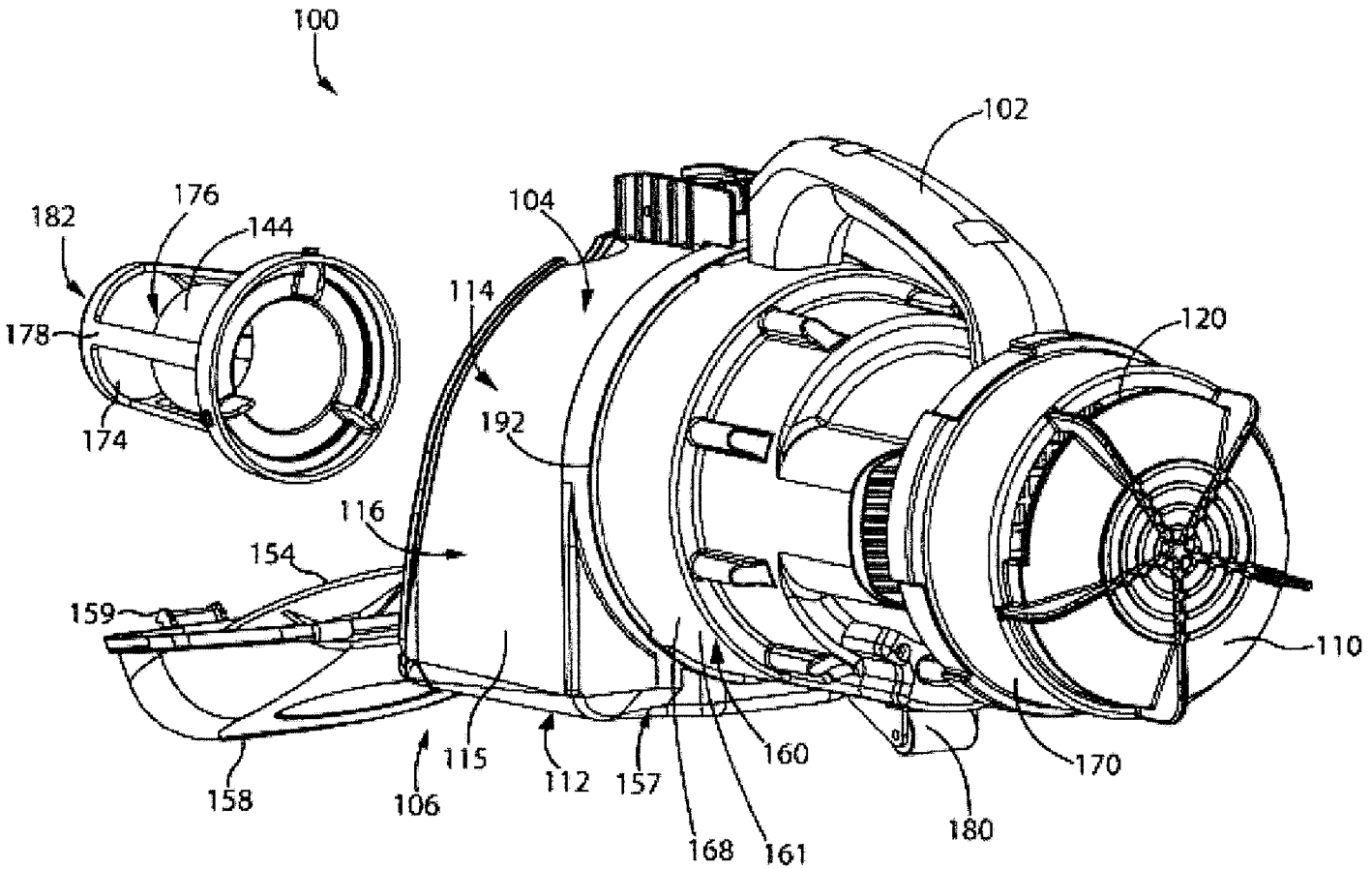
FIG. 4 is a partially exploded rear perspective view of the hand vacuum cleaner of FIG. 1.

Cyclone unit 114 may be emptied by any means known in the art. For example, one of the ends of the cyclone unit 114 may be openable. Referring to FIGS. 4 and 5, air treatment unit wall 115 comprises a front wall 158, which is at front end 190 of surface cleaning head 116. Front wall 158 is pivotally mounted to the lower outer wall 119 of the air treatment unit wall 115, such that air treatment unit 114 may be opened, and dirt chamber 124 may be emptied. When front wall 158 is pivoted away from the remainder of the air treatment unit 114, separation plate 154 and arm 156 also pivot away from the remainder of the air treatment unit. A latch 159 is provided, which secures front wall 158 to wall 115. In alternate examples, front wall 158 may be removable from air treatment unit wall 115 or the opposed end of the cyclone unit 114 may be openable.

The clean air exiting cyclone 122 passes through outlet 145 of outlet passage 144, exits surface cleaning head 116, and passes into the cleaner body 160. In the example shown, the cleaner body 160 is positioned rearward of the surface cleaning head 116. The cleaner body comprises a housing 161, which preferably houses an optional pre-motor filter 162, a suction motor 164, and an optional post-motor filter 166.

In the exemplified embodiments, the vacuum cleaner has a linear configuration. Accordingly, pre-motor filter 162 is preferably provided in the airflow path adjacent and downstream of the outlet passage 144. Pre-motor filter 162 serves to remove remaining particulate matter from air exiting the cyclone 122, and may be any type of filter, such as a foam filter. One or more filters may be used. If the vacuum cleaner is of a non-linear configuration, then pre-motor filter 162 need not be located adjacent outlet passage 144.

Suction motor 164 is provided in the airflow path adjacent and downstream of the pre-motor filter 162. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 122 preferably extend in the same direction and are generally parallel. The suction motor 164 may be any type of suction motor. If the vacuum cleaner is of a non-linear configuration, then motor 164 need not be located adjacent pre-motor filter 162.

Post motor filter 166 is provided in the airflow path downstream of, and preferably adjacent, the suction motor 164. Post motor filter serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 may comprise a plurality of apertures formed in housing 161.

In the example shown, cleaner body 160 is removably mounted to surface cleaning head 116. For example, cleaner body 160 may be entirely removable from surface cleaning head 116, or pivotally mounted to surface cleaning head 116. Accordingly, cleaner body 160 and surface cleaning head 116 may be separated in order to provide access to the interior of cleaner body 160 or surface cleaning head 116. This may allow pre-motor filter 162 to be cleaned, changed, or serviced, or motor 164 to be cleaned, changed or serviced. Alternately, or in addition, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively. If no filter element is fixedly mounted to cleaning head 116, then cleaning head 116 may be removed and washed with water.

As can be seen in FIG. 6, housing 161 preferably comprises a first portion 168 housing pre-motor filter 162, and suction motor 164, and a second portion 170 housing post-motor filter 166. Second portion 170 is openable, such as by being removably mounted to first portion 168, such that post-motor filter 166 may be cleaned, changed, or serviced.

One or more additional wheels 180 are preferably mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Cleaning head 116 has been described herein with respect to hand vacuum cleaner 100. It will be appreciated that in alternate examples, cleaning head 100 may be provided on another type of vacuum cleaner, such as an upright vacuum cleaner, or a canister type vacuum cleaner.

The invention claimed is:

1. A surface cleaning head for a vacuum cleaner for cleaning a surface comprising:

(a) a front end, a rear end and sides extending between the front end and the rear end;

(b) an enclosed air flow passage extending from an opening to an air outlet;

(c) a plurality of wheels having a lower end; and, (d) an airflow chamber upstream of the opening comprising:

(i) an upper wall;

(ii) a rear depending wall extending downwardly from the upper wall, the rear depending wall having a lower end that is positioned above the lower end of the wheels; and, (iii) the upper wall and the rear depending wall defining an air flow chamber, having an open lower end whereby the surface is visible from the upper wall when the surface cleaning head is placed on the surface and the opening to the enclosed air flow passage is provided in a rear half of the upper wall of the air flow chamber forwardly of the rear depending wall and inwardly of the sides, the opening having a rearward end, and the open lower end extends from the front end to at least the rearward end of the opening.

2. The surface cleaning head of claim 1 further comprising side depending walls.

3. The surface cleaning head of claim 2 wherein the rear depending wall and the side depending walls form a generally U-shaped air flow chamber wall.

4. The surface cleaning head of claim 2 wherein the side depending walls have a lower end that is spaced above the lower end of the wheels.

5. The surface cleaning head of claim 1 wherein the opening is in the upper wall.

6. The surface cleaning head of claim 1 wherein the airflow chamber has an absence of agitation members and air jet members.

7. The surface cleaning head of claim 1 wherein the airflow chamber extends to the front end of the surface cleaning head and a dirty air inlet is positioned at the front end of the surface cleaning head.

8. The surface cleaning head of claim 1 wherein the opening faces the surface to be cleaned when the surface cleaning head is positioned on the surface to be cleaned.

9. The surface cleaning head of claim 8 wherein the opening is in communication with a passage that extends generally vertically upwardly.

10. The surface cleaning head of claim 8 wherein the opening is in communication with a passage that extends generally vertically upwardly.

11. The surface cleaning head of claim 1 wherein the lower end of the depending walls is spaced from 0.01 to 0.175 inches above the lower end of the wheels.

12. The surface cleaning head of claim 1 wherein the lower end of the depending walls is spaced from 0.08 to 0.08 inches above the lower end of the wheels.

13. The surface cleaning head of claim 2 wherein the surface cleaning head has a longitudinal axis and a transverse width, the opening is spaced transversely inwardly from the side walls by a distance, the opening has a transverse width, and the distance is from 1 to 5 times the transverse width.

14. The surface cleaning head of claim 12 wherein the opening has a longitudinal length and is positioned rearwardly from the front end by at least a distance equal to the longitudinal length.

15. The surface cleaning head of claim 1 wherein the cleaning head is part of a hand vacuum cleaner.

16. A hand vacuum cleaner including the surface cleaning head of claim 1.

17. The surface cleaning head of claim 1 wherein the downwardly depending wall is generally U-shaped when viewed from below, the U-shape having a forwardly positioned open end, and a dirty air inlet is defined at the open end of the U-shape.

18. The surface cleaning head of claim 1 wherein the depending wall is rearwardly narrowing.

19. The surface cleaning head of claim 17 wherein the dirty air inlet has the shape of a vertically extending generally rectangular, wide, shallow slot.

* * * * *